US009590362B2

(12) United States Patent
Wan et al.

(10) Patent No.: US 9,590,362 B2
(45) Date of Patent: Mar. 7, 2017

(54) CONNECTOR HAVING A CONDUCTIVE ELASTIC SHEET RIVETED TO A CONDUCTIVE HOUSING

(71) Applicant: Tyco Electronics (Shanghai) Co. Ltd., Shanghai (CN)

(72) Inventors: Feng Wan, Shanghai (CN); Hongqiang Han, Shanghai (CN); Seen Keen Ng, Shanghai (CN); Wenyu Liu, Shanghai (CN); Chenxi Wang, Shanghai (CN)

(73) Assignee: Tyco Electronics (Shanghai) Co. Ltd., Shanghai (CN)

( * ) Notice: Subject to any disclaimer, the term of this patent is extended or adjusted under 35 U.S.C. 154(b) by 0 days.

(21) Appl. No.: 15/142,907

(22) Filed: Apr. 29, 2016

(65) Prior Publication Data

US 2016/0322758 A1 Nov. 3, 2016

(30) Foreign Application Priority Data

Apr. 30, 2015 (CN) ..... 2015 2 0275885 U

(51) Int. Cl.

| | |
|---|---|
| ***H01R 13/648*** | (2006.01) |
| ***H01R 13/6583*** | (2011.01) |
| ***H01R 13/6594*** | (2011.01) |
| ***H01R 4/06*** | (2006.01) |
| ***H01R 13/6581*** | (2011.01) |

(52) U.S. Cl.

CPC ..... *H01R 13/6583* (2013.01); *H01R 4/06* (2013.01); *H01R 13/6581* (2013.01); *H01R 13/6594* (2013.01)

(58) Field of Classification Search

CPC ..... H01R 13/648; H01R 13/658; H01R 13/65802; H01R 13/6581; H01R 13/6582

USPC ..... 439/607.01–607.59

See application file for complete search history.

(56) References Cited

U.S. PATENT DOCUMENTS

| | | | | |
|---|---|---|---|---|
| 6,478,622 | B1 * | 11/2002 | Hwang | H01R 13/65802 385/92 |
| 7,530,845 | B1 * | 5/2009 | Yang | G02B 6/4201 439/607.01 |
| 7,758,381 | B2 * | 7/2010 | Oki | H01R 13/65802 439/607.17 |
| 8,342,881 | B2 * | 1/2013 | Lang | H01R 9/038 439/607.01 |
| 9,093,794 | B2 * | 7/2015 | Curtis | H01R 13/65802 |
| 9,247,967 | B2 * | 2/2016 | Wilcox | A61B 17/7037 |
| 9,287,640 | B2 * | 3/2016 | Hirschy | H01R 12/585 |

* cited by examiner

*Primary Examiner* — Chandrika Prasad
(74) *Attorney, Agent, or Firm* — Barley Snyder

(57) ABSTRACT

A connector is disclosed. The connector includes a conductive housing having a port and a peripheral wall surrounding the port, a conductive elastic sheet riveted on the peripheral wall of the port of the housing by a plurality of rivets, and a plurality of contact spots formed on at least one of the housing and the elastic sheet. The housing and elastic sheets are electrically connected by the plurality of contact spots when the elastic sheet is riveted on the housing.

20 Claims, 5 Drawing Sheets

CONNECTOR HAVING A CONDUCTIVE ELASTIC SHEET RIVETED TO A CONDUCTIVE HOUSING

CROSS-REFERENCE TO RELATED APPLICATION

This application claims the benefit of Chinese Patent Application No. CN201520275885.6 filed on Apr. 30, 2015 in the State Intellectual Property Office of China, the whole disclosure of which is incorporated herein by reference.

FIELD OF THE INVENTION

The present invention relates to a connector, and more particularly, to a small form factor connector.

BACKGROUND

In small form factor (hereinafter "SFF") connectors known in the prior art, heat is produced in the connector when it is working. In order to dissipate heat from the connector, a heat radiator must be mounted on a housing of the connector. The heat radiator, however, is known to produce electromagnetic interference.

In order to prevent electromagnetic interference from the heat radiator interfering with the signal terminal provided inside the SFF connector, it is generally required to mount a circle of an anti-electromagnetic interference elastic sheet on a periphery wall of a port of the housing of the connector. The anti-electromagnetic interference elastic sheet is generally directly welded onto the periphery wall of the connector in the prior art. The welding of the elastic sheet leads to increased difficulty and correspondingly increased costs in manufacturing the SFF connector. Furthermore, the housing of a known SFF connector generally comprises an upper housing and a lower housing, which are also welded together. This kind of split-type housing has a relatively high manufacturing cost and sophisticated manufacturing process.

SUMMARY

An object of the invention, among others, is to provide a connector with high anti-electromagnetic interference capabilities at a reduced cost. The disclosed connector includes a conductive housing having a port and a peripheral wall surrounding the port, a conductive elastic sheet riveted on the peripheral wall of the port of the housing by a plurality of rivets, and a plurality of contact spots formed on at least one of the housing and the elastic sheet. The housing and elastic sheets are electrically connected by the plurality of contact spots when the elastic sheet is riveted on the housing.

BRIEF DESCRIPTION OF THE DRAWINGS

The invention will now be described by way of example with reference to the accompanying figures, of which.

DETAILED DESCRIPTION OF THE PREFERRED EMBODIMENT(S)

The invention is explained in greater detail below with reference to embodiments of a connector. This invention may, however, be embodied in many different forms and should not be construed as limited to the embodiments set forth herein; rather, these embodiments are provided so that this disclosure will be thorough and complete and still fully convey the scope of the invention to those skilled in the art.

Figure 1:
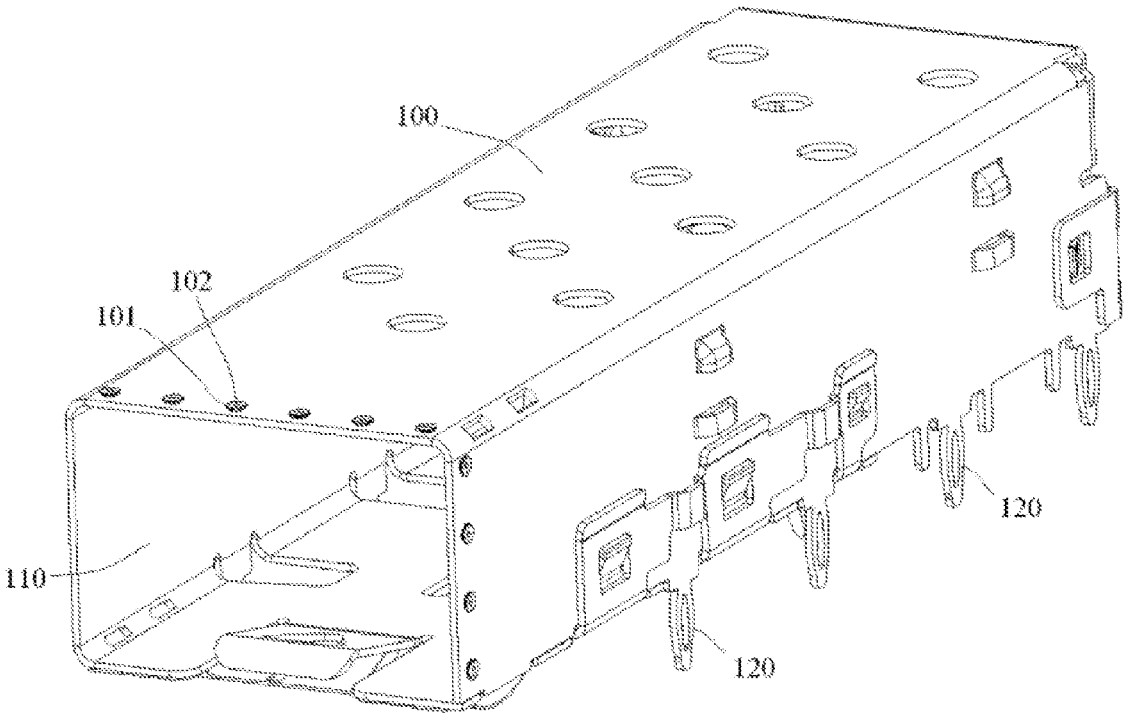
FIG. 1 is a perspective view of a housing of a connector according to the invention.
Figure 2:
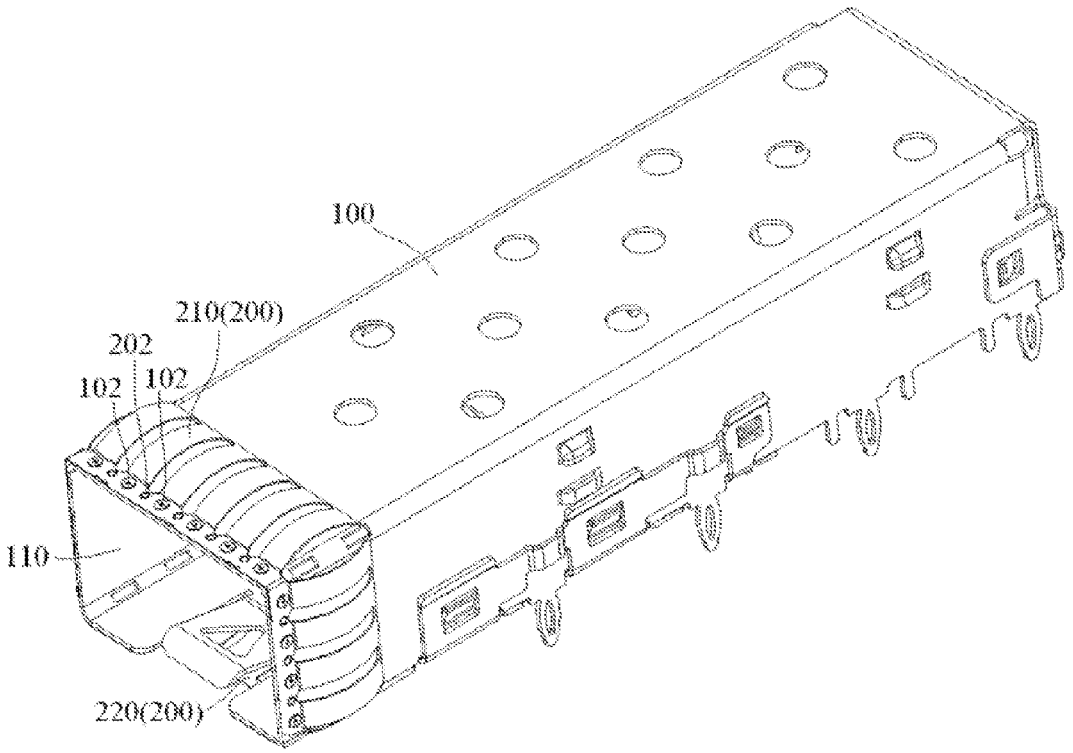
FIG. 2 is a perspective view of the housing and an elastic sheet of the connector according to the invention.

A connector according to an embodiment of the present invention is shown generally in FIGS. 1 and 2. The connector includes a housing 100 and an elastic sheet 200. The major components of the invention will now be described in greater detail.

The housing 100 is shown in FIG. 1. The housing 100 is formed of a conductive material, for example a metal material, and may be a one-piece housing made of a single sheet plate. In this way, the manufacturing process of the housing is simplified and the manufacturing cost is thus reduced.

The housing 100, as shown in FIG. 1, defines a port 110 at one end. The port 110 is constructed to receive a main body of the connector. A plurality of first riveting holes 101 are formed on and extend through the peripheral wall of the port 110. The housing 100 also has a plurality of rivets 102; each rivet 102 may fit into one of the plurality of first riveting holes 101. As also shown in FIG. 1, a bottom portion of the housing 100 is formed with a plurality of fisheye-shaped plug pins 120 adapted to plug into a circuit board (not shown).

Figure 3:
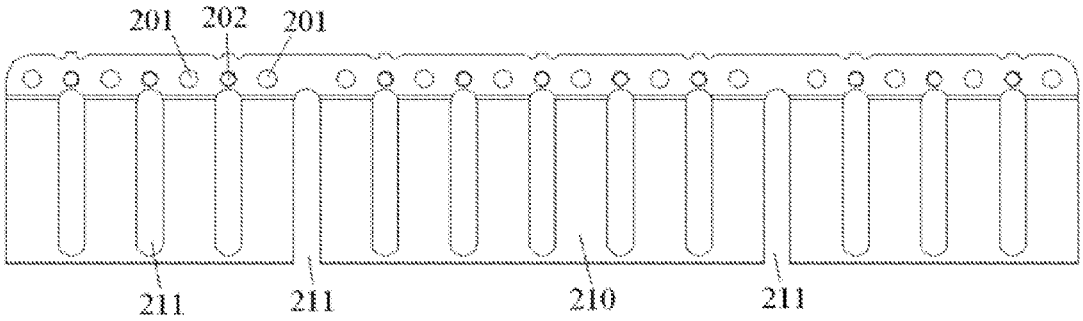
FIG. 3 is a plan view of a first elastic sheet of the elastic sheet shown in FIG. 2.
Figure 4:
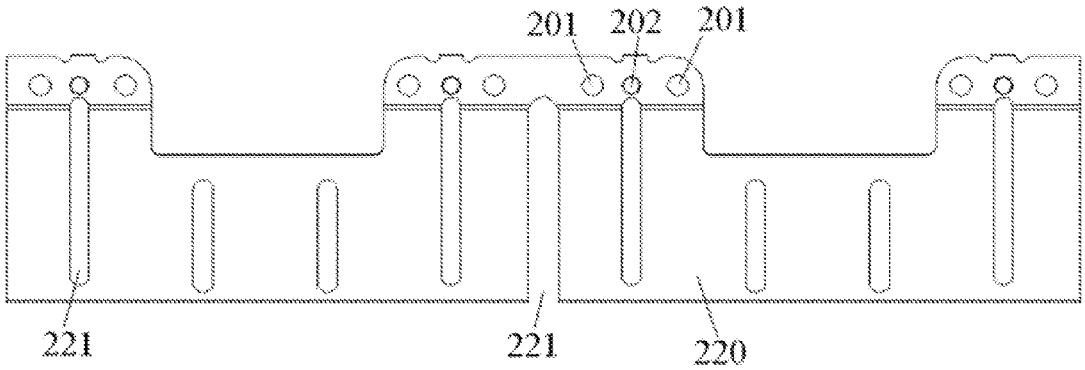
FIG. 4 is a plan view of a second elastic sheet of the elastic sheet shown in FIG. 2.

The elastic sheet 200 is shown in FIGS. 3 and 4. The elastic sheet 200 is formed of a conductive material, for example a metal material. The elastic sheet includes a first elastic sheet 210, shown in FIG. 3, and a second elastic sheet 220, shown in FIG. 4.

As shown in FIGS. 2-4, the first elastic sheet 210 and the second elastic sheet 220 each is formed with a plurality of first slots 211 separated from each other so as to improve the elasticity of the first elastic sheet 210 and the second elastic sheet 220. The second elastic sheet 220, as shown in FIG. 4, may also be formed with a second slot 221. A plurality of second riveting holes 201 are formed on and extend through each of the first elastic sheet 210 and the second elastic sheet 220. A plurality of contact spots 202 are formed on each of the first elastic sheet 210 and the second elastic sheet 220. The contact spots 202 may be formed as a rigid-projection structure.

The assembly of the housing 100 and elastic sheet 200 will now be described in greater detail. As shown in FIG. 2, the elastic sheet 200 is mounted on a periphery wall of a port 110 of the housing 100 so as to provide an electromagnetic shield for a signal terminal inside the connector.

Figure 5:
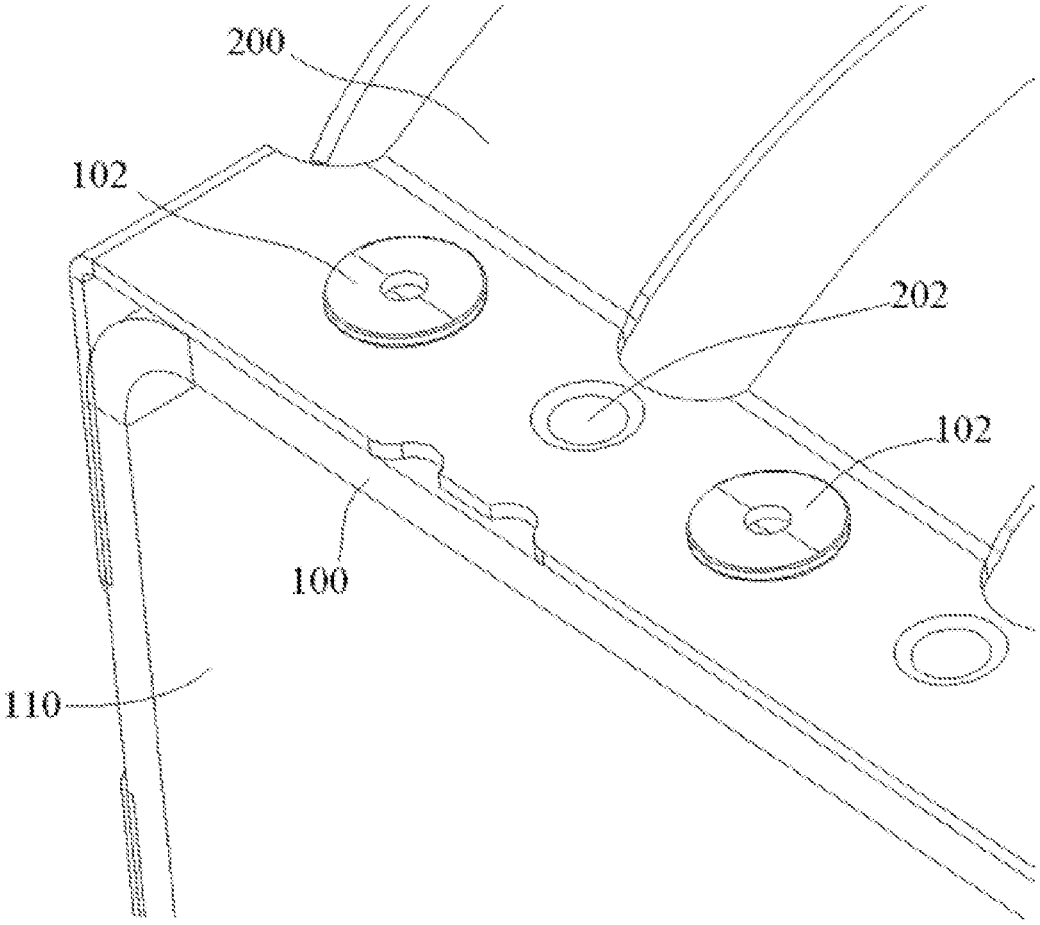
FIG. 5 is an enlarged view of the connector shown in FIG. 2.

As shown in FIGS. 2 and 5, the elastic sheet 200 is directly riveted on the peripheral wall of the port 110 of the housing 100 by means of the plurality of rivets 102. The rivet 102 passes through the first riveting hole 101 on the housing 100 and then the second riveting hole 201 on the elastic sheet 200 so as to rivet the elastic sheet 200 and the housing 100 together. The first elastic sheet 210 is riveted on the top wall and the side walls of the port 110 of the housing

100. The second elastic sheet 220 is riveted on the bottom wall of the port 110 of the housing 100.

After the elastic sheet 200 is riveted on the housing 100, one or more contact spots 202 is disposed between any two adjacent rivets 102. The plurality of contact spots 202 are pressed against the peripheral wall of the housing 100 so as to realize the reliable electrical-contact between the conductive elastic sheet 200 and the conductive housing 100.

Figure 6:
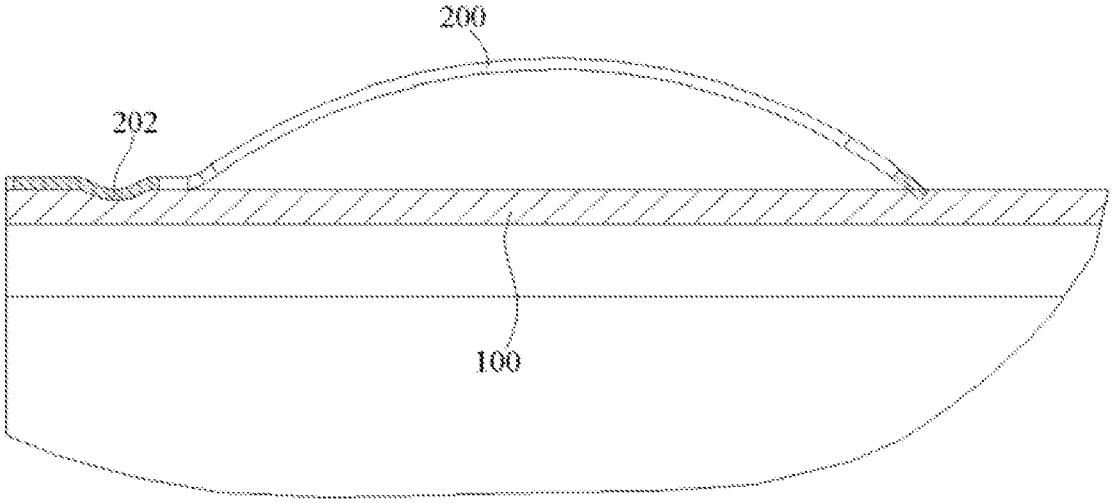
FIG. 6 is a sectional view of the connector shown in FIG. 2.

As shown in FIGS. 2 and 6, a first end of the elastic sheet 200 is riveted on the peripheral wall of the port 110 of the housing 100, and an opposite second end of the elastic sheet 200 is placed slidably on an outer wall of the housing 100. In this way, when the connector is mounted to a cage of an electronic device, the first end of the elastic sheet 200 on the housing 100 of the connector is elastically and electrically contacted to the cage of the electronic device, and is pressed by the cage of the electronic device such that the opposite second end of the elastic sheet 200 may slide on the outer wall of the housing 100.

The present invention is not limited to the illustrated embodiments. In another embodiment, for example, a plurality of contact spots may instead be formed on the housing 100, and after the elastic sheet 200 is riveted on the housing 100, the plurality of contact spots are pressed against the elastic sheet 200 so as to realize the reliable electrical-contact between the elastic sheet 200 and the housing 100. In another embodiment of the present invention, the plurality of contact spots comprise a plurality of first contact spots formed on the elastic sheet 200 and a plurality of second contact spots formed on the housing 100. After the elastic sheet 200 is riveted on the housing 100, the plurality of first contact spots are pressed against the peripheral wall of the housing 100, and the plurality of second contact spots are pressed against the elastic sheet 200 so as to realize the reliable electrical-contact between the elastic sheet 200 and the housing 100.

Advantageously, the conductive elastic sheet 200 and the conductive housing 100 are reliably electrically connected to each other through the plurality of contact spots 202. In this way, the capability of anti-electromagnetic interference of the connector is improved. Furthermore, due to the use of the rivets 102 used in the assembly of the connector, the manufacturing cost is further reduced. Additionally, in some embodiments of the present invention, the housing is a one-piece structure, for example a single sheet plate, thereby simplifying the manufacturing process of the housing and reducing the housing manufacturing cost.

What is claimed is:

1. A connector, comprising:

a conductive housing having a port and a peripheral wall surrounding the port;

a conductive elastic sheet riveted on the peripheral wall of the port of the housing by a plurality of rivets; and a plurality of contact spots formed on at least one of the housing and the elastic sheet, the housing and elastic sheet electrically connected by the plurality of contact spots when the elastic sheet is riveted on the housing.

2. The connector of claim 1, wherein the conductive housing is a metal material.

3. The connector of claim 2, wherein the conductive elastic sheet is a metal material.

4. The connector of claim 1, wherein the housing is a one-piece component formed of a single sheet plate.

5. The connector of claim 1, wherein one or more contact spots is disposed between any two adjacent rivets.

6. The connector of claim 1, wherein the plurality of contact spots are formed on the elastic sheet and pressed against the peripheral wall of the housing.

7. The connector of claim 1, wherein the plurality of contact spots are formed on the housing and pressed against the elastic sheet.

8. The connector of claim 1, wherein the plurality of contact spots include a plurality of first contact spots formed on the elastic sheet and pressed against the peripheral wall of the housing, and a plurality of second contact spots formed on the housing and pressed against the elastic sheet.

9. The connector of claim 1, wherein a plurality of first riveting holes are formed on the peripheral wall of the port of the housing.

10. The connector of claim 9, wherein a plurality of second riveting holes are formed on the elastic sheet.

11. The connector of claim 10, wherein each rivet passes through a first riveting hole and a second riveting hole so as to rivet the elastic sheet and the housing together.

12. The connector of claim 1, wherein each of the plurality of contact spots is a rigid-projection structure.

13. The connector of claim 1, wherein each of the plurality of contact spots is an elastic-projection structure.

14. The connector of claim 1, wherein the elastic sheet includes a first elastic sheet and a second elastic sheet.

15. The connector of claim 14, wherein the first elastic sheet is riveted on a top wall and side walls of the housing.

16. The connector of claim 15, wherein the second elastic sheet is riveted on a bottom wall of the housing.

17. The connector of claim 16, wherein the first elastic sheet has a plurality of first slots separated from each other and extending through the first elastic sheet.

18. The connector of claim 17, wherein and the second elastic sheet has a plurality of second slots separated from each other and extending through the second elastic sheet.

19. The connector of claim 1, wherein a first end of the elastic sheet is riveted on the peripheral wall, and an opposite second end of the elastic sheet is slidably positioned on an outer wall of the housing.

20. The connector of claim 1, wherein a bottom portion of the housing is formed with a plurality of fisheye-shaped plug pins adapted to plug into a circuit board.

* * * * *